United States Patent [19]

Menor et al.

[11] Patent Number: 4,627,089

[45] Date of Patent: Dec. 2, 1986

[54] DEVICE FOR POSITIONING A FLATTENING FILTER IN THE CENTER OF AN X-RAY RADIATION

[75] Inventors: George Menor, Martinez; Rolando Tayag, Benecia; Duc Tran, Saratoga, all of Calif.

[73] Assignee: Siemens Medical Laboratories, Inc., Walnut Creek, Calif.

[21] Appl. No.: 645,943

[22] Filed: Aug. 30, 1984

[51] Int. Cl.[4] ..... G21K 3/00

[52] U.S. Cl. ..... 378/157; 378/159

[58] Field of Search ..... 378/156, 157, 159

[56] References Cited

U.S. PATENT DOCUMENTS 3,882,314 5/1975 Benedetti et al. ..... 378/159

4,121,109 10/1978 Taumann et al. ..... 378/156

FOREIGN PATENT DOCUMENTS 0149571 7/1985 European Pat. Off. ..... 378/157

*Primary Examiner*—Craig E. Church

*Assistant Examiner*—Jack I. Berman

*Attorney, Agent, or Firm*—Mark H. Jay

[57] ABSTRACT

A device for positioning a flattening filter in the center of an x-ray radiation, which comprises a drive means for driving the flattening filter between positions outside and inside the x-ray radiation; and a stop means for restricting the inside movement of the drive means to the center position of the flattening filter.

15 Claims, 12 Drawing Figures

DEVICE FOR POSITIONING A FLATTENING FILTER IN THE CENTER OF AN X-RAY RADIATION

BACKGROUND OF THE INVENTION

1. Field of the Invention

The present invention relates to a device for positioning a flattening filter in the center of an x-ray radiation. In particular, it relates to a device for positioning a flattening filter in the center of an x-ray radiation produced by an electron accelerator for radiation therapy due to a deceleration of the electrons in a so-called target.

2. Description of the Prior Art

An electron accelerator for radiation therapy is for example described in the essay "Radiotherapy today: The Mevatron 20, a Compact Highoutput Linear Accelerator", by W. Haas, V. Stieber and L. Taumann in Electromedica 3-4/77, pages 101–106. Such an electron accelerator is also specified in the Siemens brochure "Siemens, a total resource company for radiation therapy", MG/5020-008 SIQ 785.

In the case of electron accelerators x-ray deceleration radiation is produced due to a deceleration of the electrons in a so-called target. It is known in the art to balance or compensate the dosage in a given space angle range of the x-rays leaving the target by placing a so-called flattening filter into the portion of the x-ray cone of interest. This flattening filter has a conical design and its contour path is adapted to the path of the radiation intensity at the place of use. Special kinds of flattening filters are for example described in the U.S. Pat. Nos. 4,109,154 (Taumann), 4,121,109 (Taumann et al.) and 4,343,997 (Heinz).

As indicated in column 1, lines 20–25 of Taumann's U.S. Pat. No. 4,109,154 the tip of a flattening filter must be positioned very precisely with respect to the center beam of the x-ray radiation.

SUMMARY OF THE INVENTION

1. Object

It is an object of this invention to provide a device for very quickly and precisely positioning a flattening filter in the center of an x-ray radiation.

2. Summary

According to this invention a device for positioning a flattening filter in the center of an x-ray radiation is provided which comprises:

(a) a drive means for driving the flattening filter between positions outside and inside of the x-ray radiation; and (b) a stop means for restricting the inside movement of the drive means to the center position of the flattening filter.

The stop means very precisely defines a centering position for the flattening filter as soon as the flattening filter drive means touches the stop means. Therefore, moving the drive means from outside the x-ray radiation into the stop position inside the x-ray radiation the flattening filter can very quickly and precisely be positioned in the center of the x-ray radiation.

In a preferred embodiment of the invention the stop means and the flattening filter may also define an electron window under electron mode conditions when being in positions apart from each other.

In another preferred embodiment of the invention the drive means are designated for driving a first and second flattening filter and the stop means comprises a first stop position for the drive means for centering the first flattening filter and a second stop position for centering the second flattening filter.

In this case the x-ray radiation can be switched between two different photon energies, thereby using the first flattening filter for flattening the x-ray beam having a first, e.g. higher photon energy and utilizing the second flattening filter for flattening the x-ray beam having a second, e.g. lower, photon energy.

The foregoing and other objects, features and advantages of the invention will be apparent from the following more particular description of a preferred embodiment of the invention, as illustrated in the accompanying drawings.

BRIEF DESCRIPTION OF THE DRAWINGS

In the drawings.

Throughout the drawings, like elements are referred to by like numerals.

DETAILED DESCRIPTION OF THE PREFERRED EMBODIMENT

Figure 1:
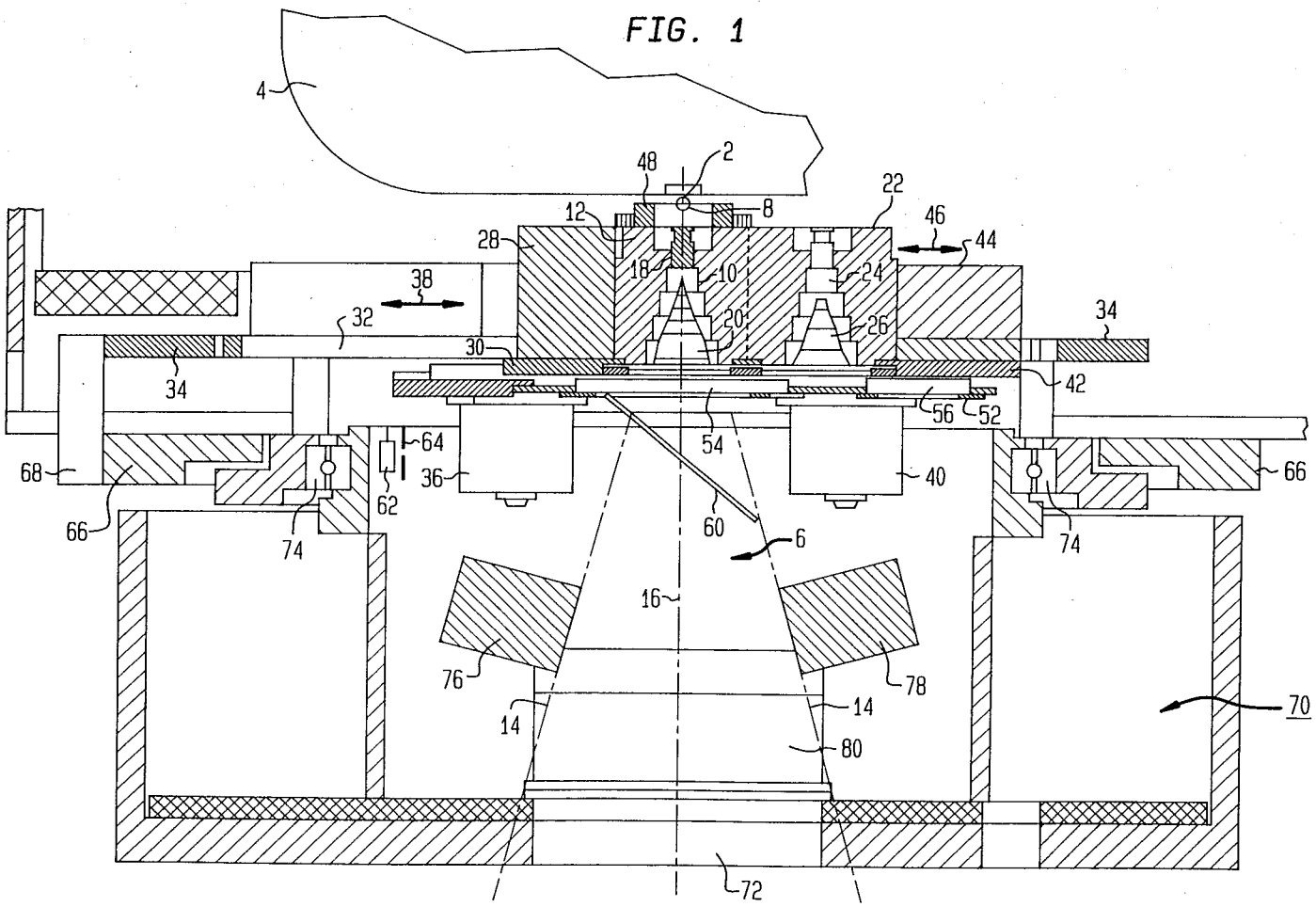
FIG. 1 is a partial cross-section of a beam-defining system of an electron accelerator in high photon energy mode comprising a device according to this invention.

As illustrated in FIG. 1, electrons of high energy are generated at exit window 2 of a vacuum envelope 4 of an electron accelerator after acceleration within a wave guide and beam bending within the vacuum envelope 4. X-ray radiation 6 is produced by collision of accelerated electrons with a target 8. The x-ray radiation 6 is in the shape of a cone. The maximum cone surface in the limits of a passageway 10 of a first collimator 12 (e.g. of tungsten) is generally designated with 14. The center of the x-ray radiation is generally designated with 16.

The passageway 10 of the first collimator 12 is stepped according to U.S. Pat. No. 4,343,997. Inside the passageway 10 are arranged an absorption member 18 for electron absorption and a first conical flattening filter 20. The tip of the conical flattening filter 20 is aligned towards the target 8.

FIG. 1 also illustrates a second collimator 22 (e.g. of tungsten) which also comprises a passageway 24. The passageway 24 has the same shape as the passageway 10 of the first collimator 12. In the passageway 24 of the second collimator 22 is positioned a second flattening filter 26. The tip of the second conical flattening filter 26 is aligned in the same way as the tip of the first flattening filter 20.

The first and second collimators 12, 22 together with the first and second flattening filters 20, 26 and a tungsten shielding block 28 are mounted on a filter carriage 30. The filter carriage 30 itself is slidably mounted within a slot 32 of a plate 34. The filter carriage 30 is connected with a first motor 36 for driving the filter carriage 30 in the directions of the double arrow 38.

In FIG. 1 there is also illustrated a second motor 40. The second motor 40 is connected with a stop carriage 42 for a block-shaped stop 44. The stop carriage 42 is also slidably mounted along the slot 32 of the plate 34. The second motor 40 drives the stop carriage 42 together with the block-shaped stop 44 in directions of the double arrow 46.

The filter carriage 30 with first motor 36, the stop carriage 42 with block-shaped stop 44 and second motor 40 and plate 34 with slot 32 form a device for quickly and accurately positioning the first flattening filter 20 or the second flattening filter 26 in the center 16 of the x-ray radiation 6. The block-shaped stop 44 and the second collimator 22 comprising the second flattening filter 26 may also define an electron window in an electron mode condition when being in positions apart from each other.

A situation, where the first flattening filter 20 is positioned in the center of the x-ray radiation 6 is depicted in FIG. 1. This is the position for the high photon energy mode (first photon energy mode).

Figure 2:
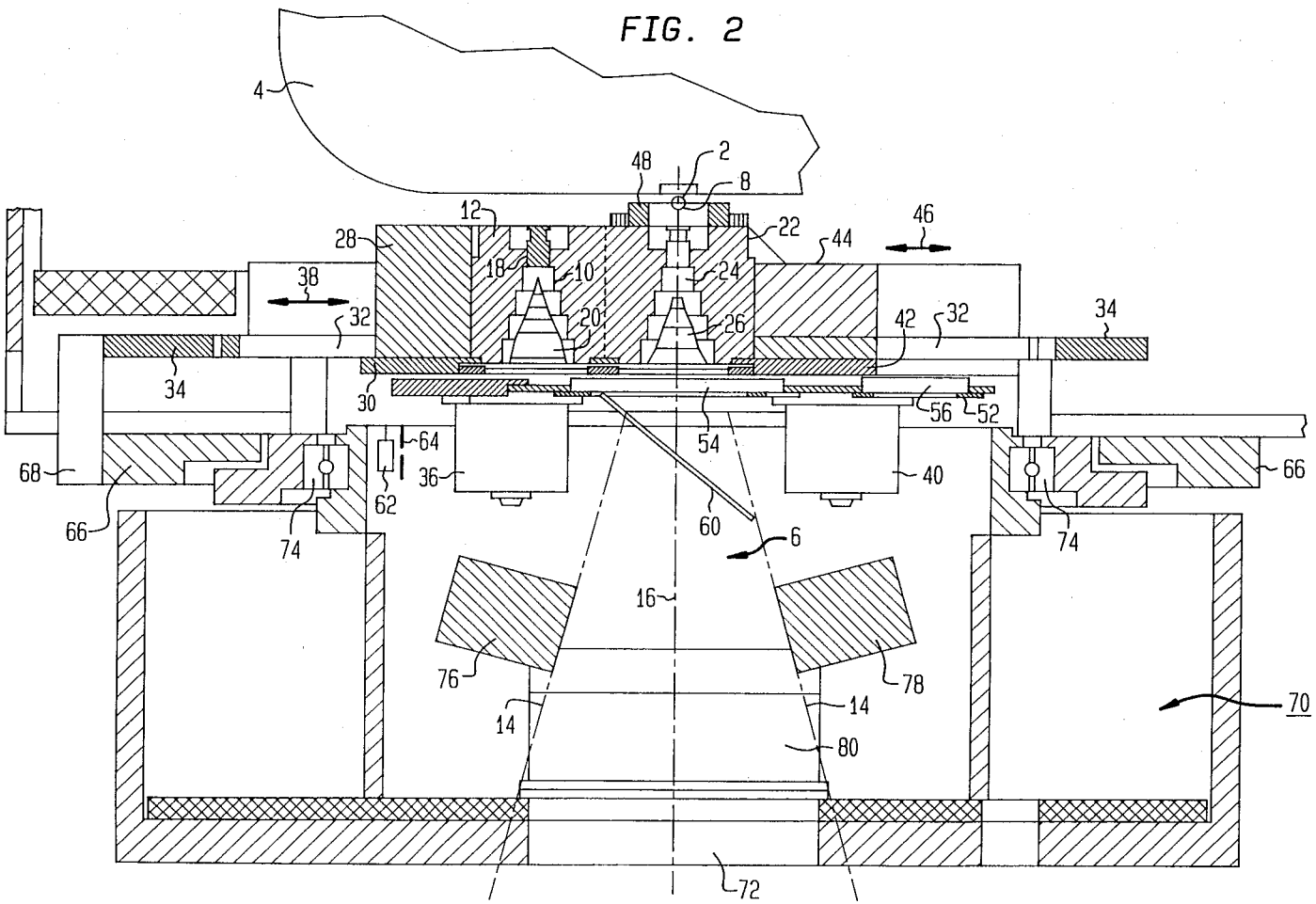
FIG. 2 is a partial cross-section of a beam defining system of an electron accelerator in low photon energy mode comprising a device according to this invention.

The situation, when the second flattening filter 26 is positioned in the center of the x-ray radiation 6 is illustrated in FIG. 2. In this situation, where the filter carriage 30 together with the first and second flattening filters 20 and 26 and the stop carriage 42 together with the block-shaped stop 44 have been moved by one step to the left, the electron accelerator works in a low photon energy mode (second photon energy mode).

Figure 3:
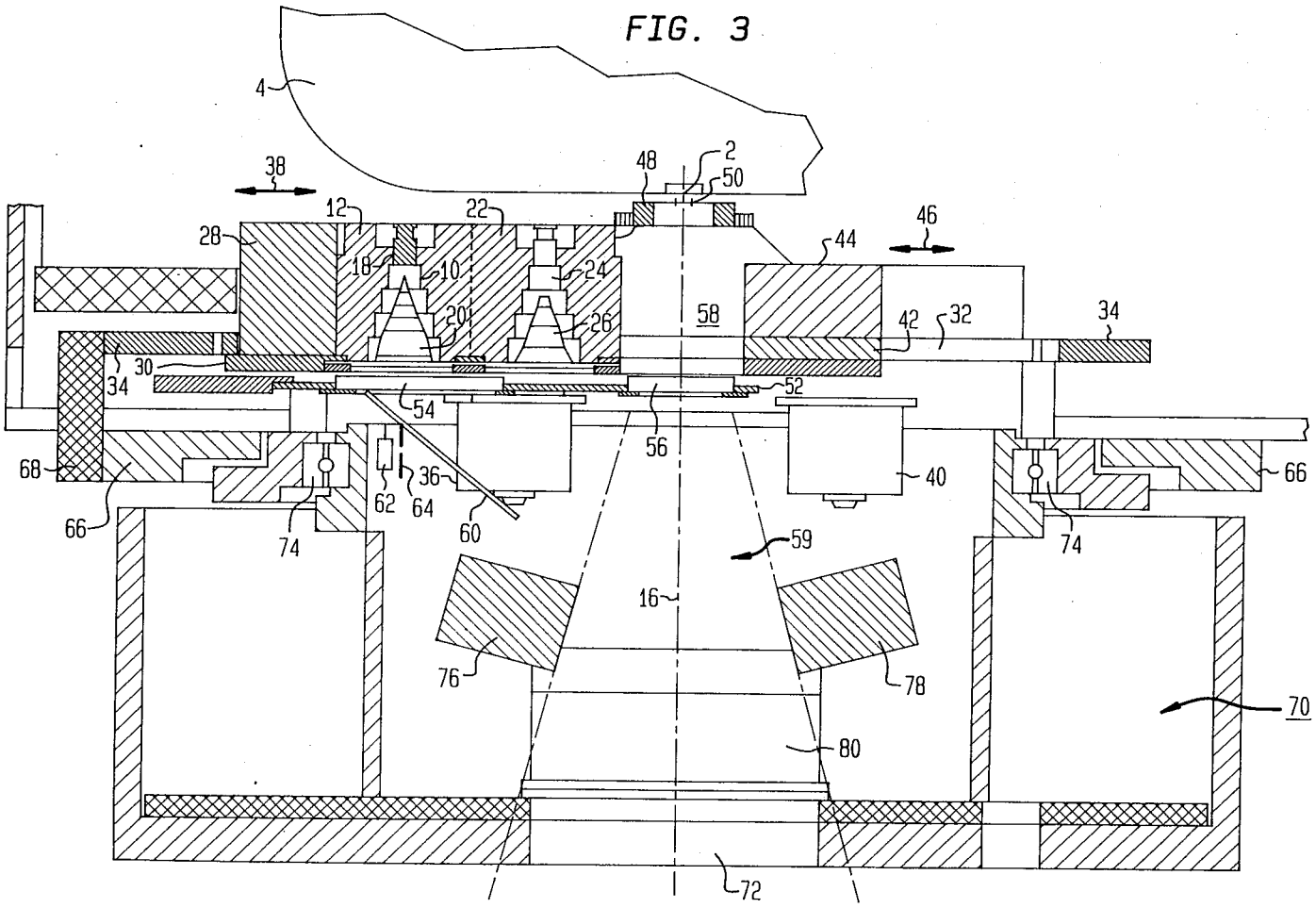
FIG. 3 is a partial cross-section of a beam defining system of an electron accelerator in electron mode comprising a device according to this invention.

FIG. 3 finally shows the situation, where the stop carriage 42 together with block-shaped stop 44 is in the same position as in FIG. 2, however, where the filter carriage 30 together with the first and second flattening filters 20, 26 have been moved still another step to the left. In this situation, the electron accelerator works in the electron mode. For this purpose, a slide 48, which carries the target 8 and which also carries at least one primary scattering foil 50 has perpendicularly been moved to the directions of double arrows 38 and 46 so that the scattering foil 50 instead of the target 8 is now lying underneath the exit window of the vacuum envelope 4 of the electron accelerator. In case of switching back to one of the photon energy modes the target 8 instead of the scattering filter 50 has to be moved back into the position shown in FIGS. 1 and 2. Also in electron mode, a slide 52 carrying an x-ray dose chamber 54 and a secondary scattering foil 56 has been moved by one step to the left so that the secondary scattering foil 56 is now positioned beneath the window 58 in the electron beam 59. For the two energy modes shown in FIGS. 1 and 2, slide 52 is in a position where the x-ray dose chamber 54 is arranged in the path of x-ray radiation 6. Slide 52 also carries a light field mirror 60 for the x-ray radiation 6. The associated light source is generally designated with 62. The element 64 is a plate disc 64 in front of the light source 62.

As illustrated in FIGS. 1, 2 and 3 the plate 34 is mounted on a bearing plate 66 by means of columns 68. A steel housing 70 having a window 72 for x-ray or electron radiation is attached to the bearing plate 66 by means of a bearing 74 for rotation. The elements 76, 78, and 80 are jaws of an x-ray shielding jaws system.

Figure 4:
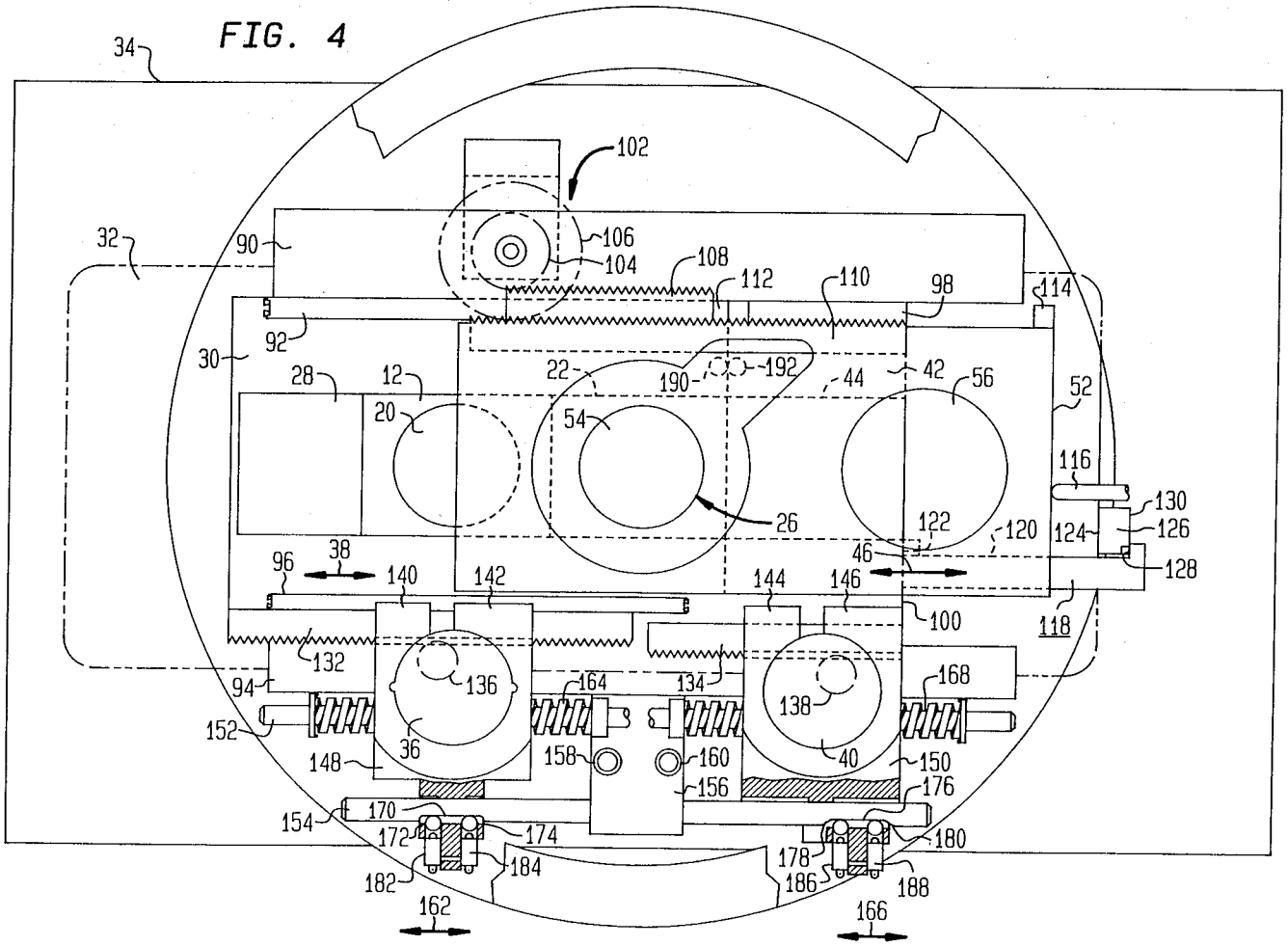
FIG. 4 is an embodiment for a device according to this invention in more detail.

FIG. 4 shows a positioning device according to the invention in more detail in a bottom view with respect to FIGS. 1, 2, and 3. As indicated in FIG. 4 the filter carriage 30 is slidably mounted to plate 34 by means of bearing members 90, 92 and 94, 96. Correspondingly the stop carriage 42 is slidably attached to plate 34 by means of bearing members 90, 98 and 90, 100.

On bearing member 90 there is also positioned a gear wheel 102 comprising a smaller sprocket 104 and a larger sprocket 106. The smaller sprocket 104 together with a first rack 108 form a first rack-and-pinion drive. The larger sprocket 106 together with a second rack 110 outline a second rack-and-pinion drive. The first rack 108 is mounted at the filter carriage 30. The second rack 110 is arranged at the slide 52 for the x-ray dose chamber 54 and the secondary scattering foil 56. As soon as the filter carriage 30 from the low photon energy position, as shown in FIG. 2, moves further to the left into the electron mode position of FIG. 3 the first rack 108 starts to rotate the smaller sprocket 104. Under these circumstances also the larger sprocket 106 starts rotating, thereby driving the second rack 110 to the left. Due to that slide 52 moves to the left. All driving movements are so coordinated with respect to each other that in the leftiest end position of the filter carriage 30 in electron mode as indicated in FIG. 3 the slide 52 is also in its leftiest position, namely wherein the secondary scattering foil 56 is arranged beneath window 58 in the electron beam 59. The leftiest positions of filter carriage 30 and slide 52 are limited by an arrangement of a first stop 112 positioned on the stop carriage 4 and a second stop 114 mounted on slide 52 as indicated in FIG. 4. The utmost position to the right of slide 52 is limited by a third stop 116.

The stop carriage 42 also comprises a limiting arm 118 having a clearance 120. A first arm edge 122 at the left end of the clearance 120 together with a first (left) limiting plane 124 of an arm stop 126 confine the stop position of the block-shaped stop 44 when the electron accelerator is switched to high photon mode. A second arm edge 128 at the right end of the clearance 120 together with a second (right) limiting plane 130 of arm stop 126 curb the stop position of the block-shaped stop 44 in either the low photon energy or the electron mode situation. The arm stop 126 is mounted at plate 34.

Thus according to the invention, the block-shaped stop 44 in its first (extremely right) position defines an accurate stop for very quickly and precisely positioning the first flattening filter 20 in the center 16 of the x-ray radiation 6 for high photon energy mode purposes.

However, in its second (extremely left) position the block-shaped stop 44 either forms another accurate stop for very quickly and precisely positioning the second flattening filter 26 in the center 16 of the x-ray radiation 6 for low photon energy purposes or a stop for very quickly and precisely opening the window 58 for electron mode purposes.

In the last case, when the second stop 114 touches the first stop 112 rotation of sprockets 104 and 106 stops immediately. Due to that the smaller sprocket 104 keeps the filter carriage 30 together with collimators 12 and 22 in their leftiest position, which is the position for electron mode as indicated in FIG. 3.

As further illustrated in FIG. 4 the filter carriage 30 also comprises a third rack 132 and the stop carriage 42 contains a fourth rack 134. The third rack 132 is activated by a first motor sprocket 136 as part of the gear of the first motor 36. The fourth rack 134 is driven by a second motor sprocket 138 as portion of the gear of the second motor 40.

The first and second motors 36, 40 are mounted in clamps 140, 142, 144 and 146 of a first and second motor supports 148, 150, respectively. The motor supports 148 and 150 are carried by a motor shaft 152 and a switch shaft 154. Both shafts 152 and 154 are connected with each other by means of a mounting plate 156 which is attached to plate 34 by means of mounting screws 158, 160.

The support 148 for the first motor 36 is slidably positioned on motor shaft 152 and switch shaft 154 in directions of double arrow 162. Movement is performed against the force of a spring 164. The support 150 for the second motor 40 is also slidably arranged on motor shaft 152 and switch shaft 154 in directions of double arrow 166. Again movement is done against the force of a spring 168.

The switch shaft 154 includes a first shaft clearance 170 defining a first and second shaft edges 172 and 174. It also comprises a second shaft clearance 176 outlining third and fourth shaft edges 178, 180. The shaft edges 172, 174 may trigger a first and second shaft switches 182, 184 mounted at the first motor support 148 and the shaft edges 178, 180 may trigger a third and fourth shaft switches 186, 188, respectively.

The elements 190, 192 in FIG. 4 indicate balls of a ball stop for collimator 22 on filter carriage 30 and the block-shaped stop 44 on stop carriage 42. The ball stop ensures very touching in one point.

The operation of the device of FIG. 4 with respect to the different modes of the electron accelerator is as follows:

High photon energy mode according to FIG. 1:

In this case, the second motor 40 rotates clockwise and drives the stop carriage 42 together with the block-shaped stop 44 to the right. The first motor 36 rotates also in clockwise direction and drives the filter carriage 30 together with the first and second flattening filters 20, 26 to the right. When reaching the extremely right position the first arm edge 122 of the limiting arm 118 touches the first (left) limiting plane 124 of the arm stop 126 and prevents the stop carriage 42 from further travelling to the right. However, the second motor 40 continues rotating in clockwise direction. Due to that the second motor 40 together with its motor support 150 moves to the left against the force of spring 168 by means of gear 134, 138. The third shaft switch 186 is actuated by the third shaft edge 178 in the sense of switching off the second motor 40 from further rotation. The stop carriage 42 together with the block-shaped stop 44 are precisely and firmly held in the extremely right position. At the moment the ball 190 of the filter carriage 30 touches the ball 192 of the stop carriage 42 also the filter carriage is prevented from further travelling to the right. However, similarly to the second motor 40, the first motor 36 continues rotating in clockwise direction. In equivalence to second motor 40, the first motor 36 together with motor support 148 moves to the left and the first shaft switch 182 is triggered by the first shaft edge 172 in the sense of switching off first motor 36. Due to that the first flattening filter 20 is very precisely positioned in the center 16 of the x-ray radiation 6.

Low photon energy mode according to FIG. 2:

Here the second motor 40 drives the block carriage 42 together with the block-shaped stop 44 in its extremely left position (as for example indicated in FIG. 4). When the second motor 40 continues rotating in counterclockwise direction the second arm edge 128 of limiting arm 118 touches the second limiting plane 130 of arm stop 126 and prevents the block carriage 42 from further travelling to the left. Due to that the motor 40 together with its motor support 150 move to the right by means of gear 134, 138. Now the fourth shaft switch 188 is actuated by the fourth shaft edge 180 to switch off second motor 40. Under these circumstances the block-shaped stop 44 is kept in its extremely left position. The first motor 36 at the beginning may also rotate counterclockwise. However, when the fourth switch 188 becomes actuated, the motor rotation is switched from counterclockwise to clockwise rotation. The filter carriage 30 moves to the right until the ball 190 touches the ball 192. The filter carriage 30 is stopped so that motor 36 and motor support 148 are forced to move to the left until shaft switch 182 switches the motor 36 off. In the aforedescribed end positions of the filter and stop carriages the second flattening filter 26 is accurately positioned in the center 16 of the x-ray radiation 6.

Electron mode according to FIG. 3:

In this case, the stop carriage 42 together with the block-shaped stop 44 have been moved into the extremely left position by second motor 40 as previously described for the low photon energy mode. However, no reverse signal for the first motor 36 will be generated at the moment the stop carriage 42 reaches its extremely left end position. Instead, the first motor 36 continues rotating in counterclockwise direction until the filter carriage 12 arrives at its extremely left position, namely when second stop 114 touches first stop 112. The filter carriage 12 is stopped and the first motor 36 is switched off by the second shaft switch 184 via second shaft edge 174 when the first motor 36 together with its motor support 148 are forced to move to the right.

Figure 5:
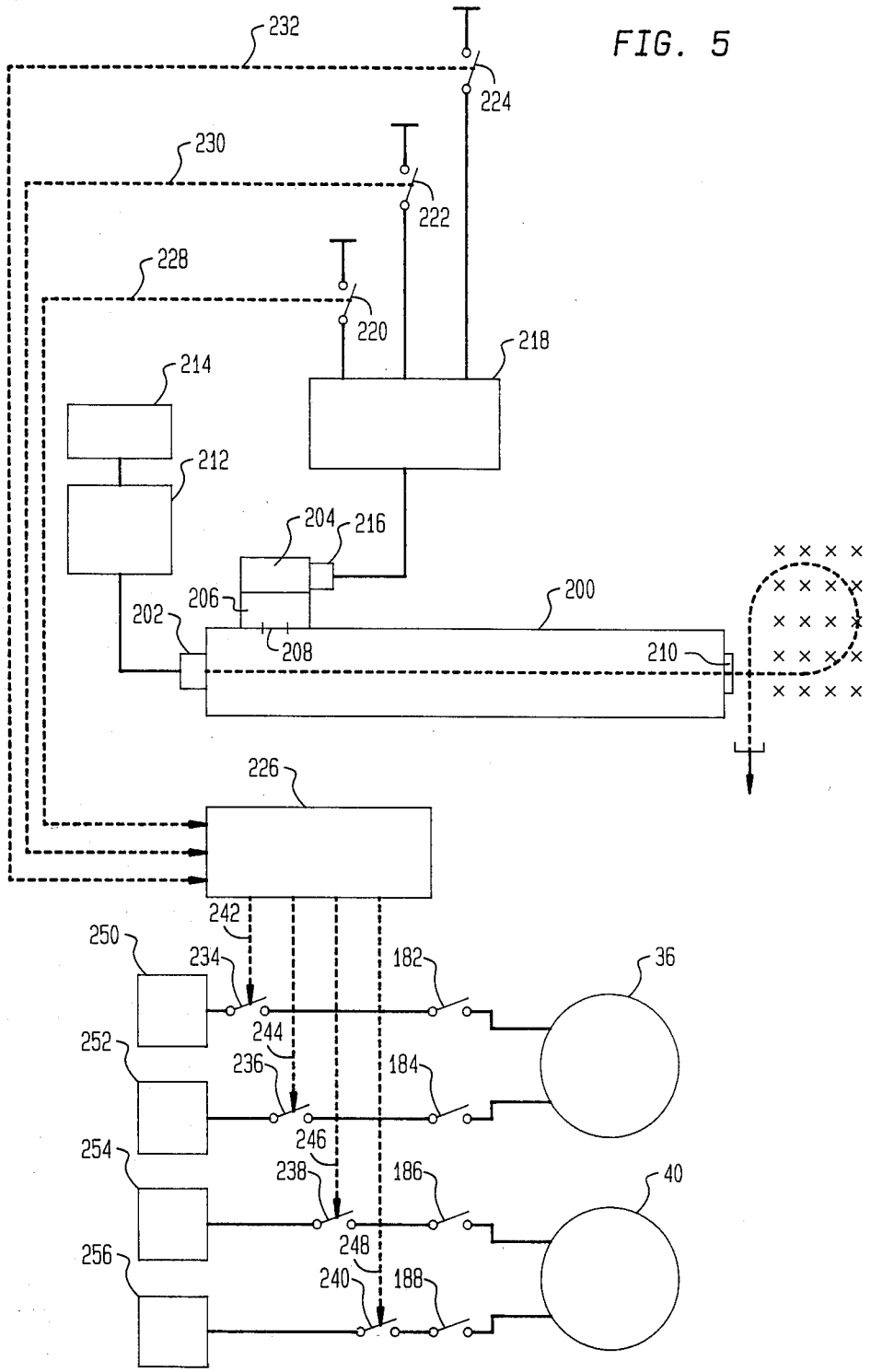
FIG. 5 is a schematic block diagram of an electron accelerator comprising the invention.

FIG. 5 illustrates a schematic block diagram of an electron accelerator comprising a device according to FIG. 4. The electron accelerator includes a waveguide 200 comprising an electron gun 202, a suitable radio frequency (RF) source 204, a radio frequency coupling element 206, a radio frequency input window 208 and an electron exit window 210. The power supply for the electron gun 202 is generally designated by 212. The power supply 212 is connected with a power supply adjusting means 214. The radio frequency source 204 comprises a radio frequency power adjusting means 216, which is connected with the output of a radio frequency power control circuit 218. The radio frequency power control circuit 218 comprises a first, second and third input switches 220, 222, 224 for high photon energy mode (e.g. 10, 15, 20 MV), low photon energy mode (e.g. 6, 8, 10 MV) and electron mode (e.g. 6–12 MV), respectively. All input switches 220, 222, 224 are controlled such that when one input switch is closed the other ones are open.

The status of each input switch 220, 222, 224 is also transferred to a logic switch control 226 via lines 228, 230 and 232. The logic switch control 226 controls a first, second, third and fourth motor switches 234, 236, 238, 240 via lines 242, 244, 246 and 248. The first and second motor switches 234, 236 together with the first and second shaft switches 182, 184 control the ON and OFF and the directions of rotation of the first motor 36 via a motor power supply unit 250 for clockwise rotation and a motor power supply unit 252 for counterclockwise rotation.

Correspondingly the third and fourth motor switches 238, 240 together with the third and fourth shaft switches 186, 188 control the ON and OFF and the direction of rotation of the second motor 40 via a motor power supply unit 254 for clockwise rotation and a motor power supply unit 254 for counterclockwise rotation.

Figure 6:
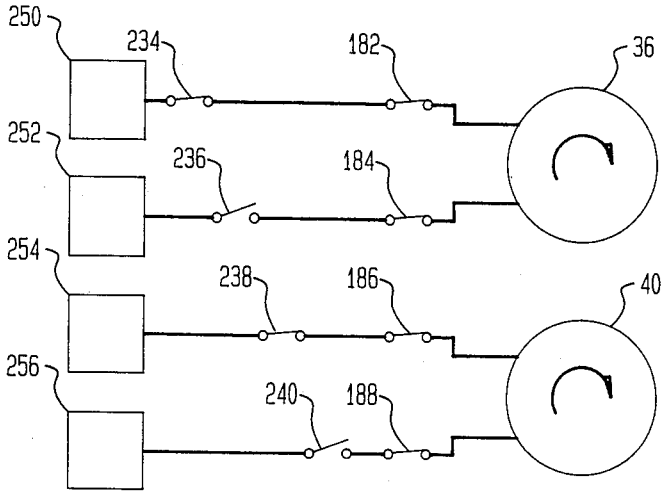
FIG. 6 is a schematic block diagram of a motor circuit comprised of the invention in motor start position for high photon energy mode.
Figure 7:
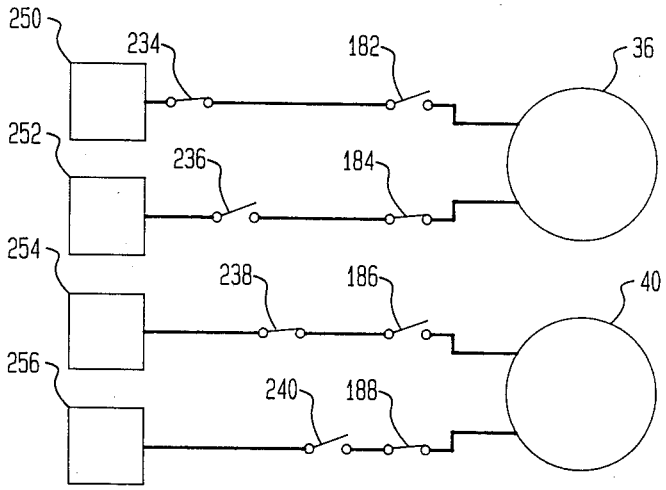
FIG. 7 is the block diagram of FIG. 6 in motor end position.

The positions of all switches for high photon energy mode at motor start position are indicated in FIG. 6. The switch positions at motor end positions are illustrated in FIG. 7.

Figure 8:
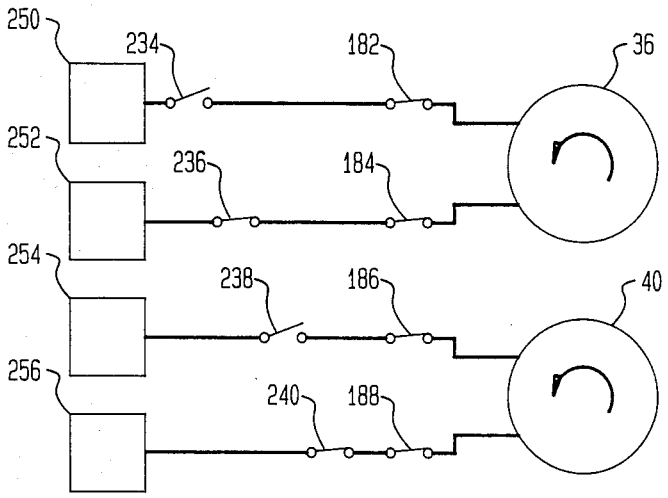
FIG. 8 is a schematic block diagram of a motor circuit comprised of the invention in motor start position for low photon energy mode.
Figure 10:
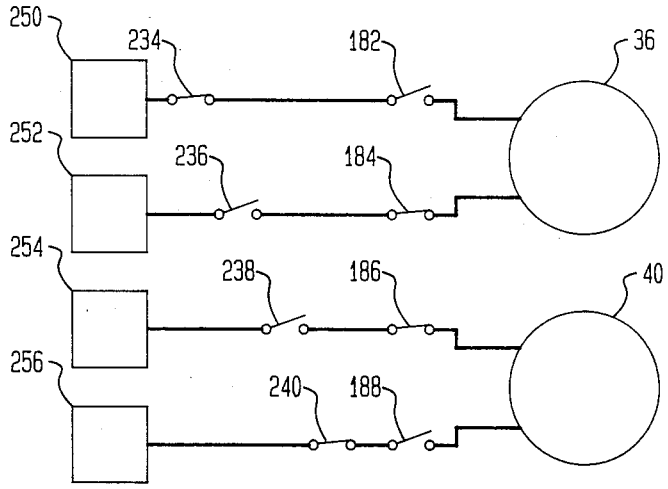
FIG. 10 is the block diagram of FIG. 8 in motor end position.

FIGS. 8 and 10 show the switch positions in motor start and motor end positions for low photon energy mode.

Figure 9:
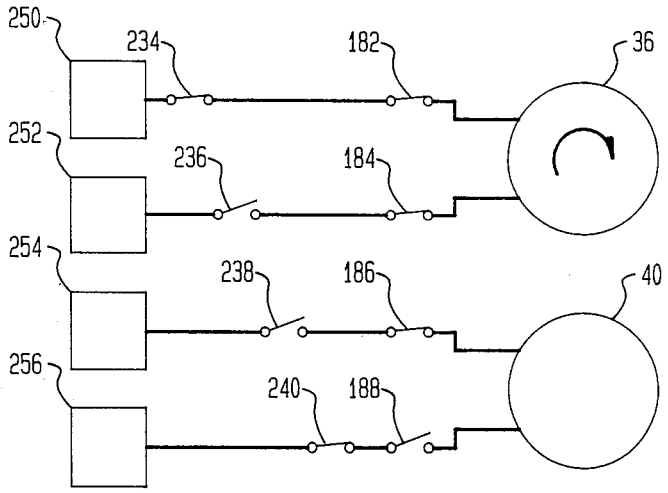
FIG. 9 is the block diagram of FIG. 8 in a motor position between motor start and end positions.

FIG. 9 depicts the situation when motor 40 is in the end position and motor 36 reverses the direction of rotation.

Figure 11:
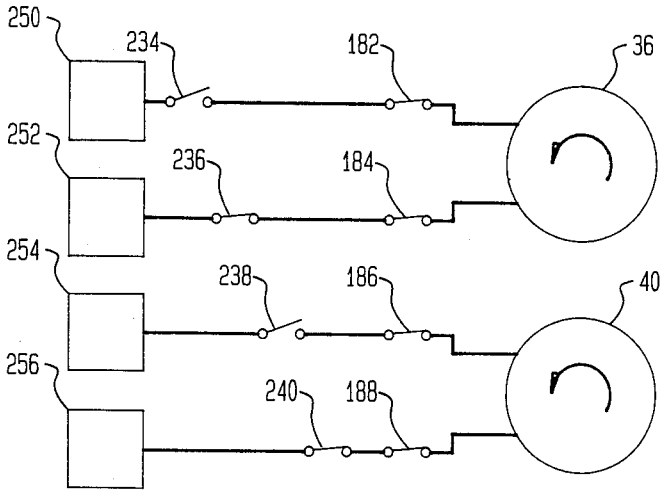
FIG. 11 is a schematic block diagram of a motor circuit comprised of the invention in motor start position for electron mode.
Figure 12:
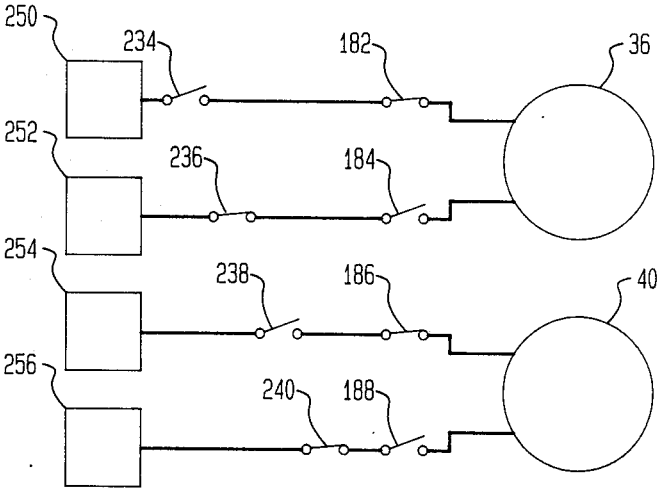
FIG. 12 is the block diagram of FIG. 11 in motor end position.

FIGS. 11 and 12 illustrate the switch positions in motor start and end positions for electron mode.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed is:

1. An electron accelerator comprising:

(a) means for producing an electron beam;

(b) a target removably inserted into the electron beam for producing x-ray deceleration radiation;

(c) means for switching between a first and a second x-ray energy mode and an electron mode;

(d) a first collimator surrounding a first flattening filter and a second collimator surrounding a second flattening filter;

(e) a device for positioning the first and second flattening filters in the center of the x-ray deceleration radiation when the accelerator is operating in the first and second x-ray energy mode, respectively, said device comprising:

(e1) a stop means including a stop carrier and a stop carrier motor for driving the stop carrier between a first and a second stop position relative to the x-ray deceleration radiation;

(e2) a drive means including a filter carrier carrying the collimators and flattening filters, and a filter carriage motor for driving the filter carriage between a first and a second position relative to the stop carrier, whereby when both the stop carrier and the filter carrier are in their first positions, the first flattening filter is in the center of the x-ray deceleration radiation and when the stop carrier is in its second position and the filter carrier in its first position, the second flattening filter is in the center of the x-ray deceleration radiation and when both the stop carrier and the filter are in their second position, the stop means and the second collimator define an electron window for the electron mode.

2. The device according to claim 1, wherein the stop means further comprise a limiting arm for defining the first and second stop positions of the stop means.

3. The device according to claim 2, wherein the limiting arm comprises a clearance and wherein the arm edge at one end of the clearance defines a stop for the first stop position and the arm edge at the other end of the clearance defines a stop for the second stop position.

4. The device according to claim 3, further comprising an arm stop for each end of the clearance of the limiting arm, said arm stop being mounted on a mounting plate for the drive means and the stop means.

5. The device according to claim 1, wherein the filter carriage motor includes a first sprocket and the stop carriage motor includes a second sprocket and wherein each carriage comprises a rack and wherein the first sprocket actuates the rack of the filter carriage when the filter carriage motor rotates and wherein the second sprocket actuates the rack of the stop carriage when the stop carriage motor rotates.

6. The device according to claim 5, wherein the filter carriage and the stop carriage motors are slidably mounted on a motor shaft and a switch shaft and wherein the filter carriage motor further comprises a first and second shaft switches and the stop carriage motor further comprises a third and fourth shaft switches and wherein the first and second shaft switches are actuated by the switch shaft when the filter carriage motor moves along both shafts in a first and second direction, respectively, the third and fourth shaft switch are actuated by the switch shaft when the stop means motor moves along both shafts in a first and second direction, respectively.

7. The device according to claim 6, wherein each shaft switch is actuated for switching off the corresponding motor in a first or second moving direction.

8. The device according to claim 6, wherein the switch shaft comprises a first clearance forming a first and second switch shaft edges and a second clearance forming a third and fourth switch shaft edges, wherein the first switch shaft edge is designated for actuating the first shaft switch, the second switch shaft edge is designated for actuating the second shaft switch, the third switch shaft edge is designated for actuating the third shaft switch and the fourth switch shaft edge is designated for actuating the fourth shaft switch.

9. The device according to claim 6, wherein the filter carriage motor is slidably mounted at the motor shaft against the force of a first spring and the stop carriage means motor is slidably mounted at the motor shaft against the force of a second spring.

10. The device according to claim 1, further comprising a slide having a first and second opening and a slide drive means connected with the flattening filter drive means for driving the first opening into the center of the x-ray radiation when one of the flattening filters is driven into the center and for driving the second opening into the center of the electron radiation when the stop means and the flattening filters are driven to define an electron window.

11. The device according to claim 10, wherein the first opening contains an x-ray dose chamber and the second opening includes a secondary scattering foil for electrons.

12. The device according to claim 10, wherein the slide drive means further comprises:

(a) a first sprocket mounted on a mounting plate for the flattening filter drive means, the stop drive means and the slide;

(b) a second sprocket connected with the first sprocket;

(c) a first rack for actuating the first sprocket being mounted on the flattening filter drive means; and (d) a second rack for being actuated by the second sprocket, when the first sprocket becomes actuated, being mounted on the slide.

13. The drive according to claim 12, wherein the slide further comprises a stop for each slide movement direction and wherein at least one stop comprises a first stop mounted at the stop means and a second stop mounted at the slide for restricting the slide movement and via first and second sprockets and first and second racks also the movement of the flattening filter drive means.

14. A device for positioning a flattening filter in the center of an x-ray radiation, comprising:

(a) a drive means for driving the flattening filter between positions outside and inside the x-ray radiation, said drive means including a filter carriage and a filter carriage motor which drives the filter carriage and comprises a first and second switch;

(b) a stop means for restricting the inside movement of the drive means to the center position of the flattening filter, said stop means including a stop carriage and a stop carriage motor which drives the stop carriage and comprises a third and fourth switch;

(c) a motor shaft on which each motor is slidably mounted against the force of a spring;

wherein the first and second switch are actuated for switching off the filter carriage motor when it moves along the shaft in a first and second direction, respectively, and the third and fourth switch are activated when the stop carrier motor moves along the shaft in a first and second direction, respectively.

15. An electron accelerator according to claim 1, wherein the position in which each carriage is driven depends on the switch status of the switching means.

* * * * *